US005485930A

United States Patent [19]

Rushing

[11] Patent Number: 5,485,930

[45] Date of Patent: Jan. 23, 1996

[54] ANTI-THEFT DISPLAY HOOK

[75] Inventor: Tatsuo Rushing, Denville, N.J.

[73] Assignee: HMG Worldwide Corporation, New York, N.Y.

[21] Appl. No.: 274,959

[22] Filed: Jul. 14, 1994

[51] Int. Cl.[6] ..... B42F 15/00

[52] U.S. Cl. ..... 211/59.1; 248/303

[58] Field of Search ..... 248/303, 304, 248/306, 222.1, 551, 220.4, 220.2; 211/59.1, 57.1, 4

[56] References Cited

U.S. PATENT DOCUMENTS

| | | | |
|---|---|---|---|
| 4,394,909 | 7/1983 | Valiulis et al. | 211/59.1 |
| 4,474,300 | 10/1984 | Entis | 211/59.1 X |
| 5,259,220 | 11/1993 | Fredrickson | 211/59.1 X |
| 5,322,175 | 6/1994 | Nobili | 211/59.1 X |
| 5,348,167 | 9/1994 | Jensen | 211/59.1 X |
| 5,375,725 | 12/1994 | Rosenthal | 211/59.1 |

*Primary Examiner*—Ramon O. Ramirez

*Attorney, Agent, or Firm*—Cohen, Pontani, Lieberman & Pavane

[57] ABSTRACT

A merchandise display device for supporting a plurality of superposed articles defining a respective centrally positioned aperture. The device includes an elongated member having a distal end dimensioned and arranged for insertion into the aperture of each article, a securing assembly for securing the elongated member to the upright member of a gondola display or similar structure in an outwardly projecting manner, and an article blocking assembly disposed proximate the distal end of the elongated member. The blocking assembly includes a pivoting flap member defining a first portion insertable between first and second adjacent articles on the elongated member so as to permit removal of the first adjacent article and prevent removal of the second adjacent article.

14 Claims, 2 Drawing Sheets

ANTI-THEFT DISPLAY HOOK

FIELD OF THE INVENTION

The present invention relates to merchandise display structures in general, and more particularly, to a display hook securable to an upright panel or other vertically oriented member so as to project outwardly therefrom.

DESCRIPTION OF THE PRIOR ART

An ever increasing problem faced by retailers is "shrink"—inventory losses attributable to shoplifting. In an effort to minimize such losses, retailers have resorted to various measures, including the use of strategically placed mirrors and/or video cameras. The success of these measures requires constant vigilance on the part of the store employees. Unfortunately, store employees have so many other duties to perform during a typical shift that brief moments of inattention are bound to occur. A shoplifter can often capitalize on such moments by quickly concealing a large quantity of a small, relatively expensive item. Accordingly, common targets of the shoplifter include rolls of film, over-the-counter medications, birth control products, and the like.

Merchandise for sale is typically presented to the retail consumer via gondola display structures. Gondola display structures are widely used in marketing to display goods or items for sale in a manner appealing to the average consumer and generally have a floor contacting base, a pair of upright members extending vertically from the rear of the base, and a vertically oriented, apertured panel member (resembling pegboard) interconnecting the uprights. Depending upon the shapes, dimensions, and packaging of the articles to be displayed, gondola displays may employ vertically spaced shelves secured to the uprights or peg hooks secured to horizontally spaced apertures in the panel member. In the latter type of configuration, the packaging of the item to be displayed defines a central hole located proximate its upper edge to accommodate the peg hook.

Frequently, the items most attractive to shoplifters are displayed on the peg hook type of device. This display configuration, may in fact, be conducive to shoplifting in that it permits a large number of superposed items to be quickly slid off the peg hook in one motion and without disturbing adjacent columns of items. Accordingly, there is a need for a peg-hook type of device capable of regulating the number of superposed articles that may be removed at one time.

It is therefore an object of the present invention to provide a hook-type display device which discourages pilferage by preventing the simultaneous removal of articles displayed thereon.

It is a further object of the present invention to provide a hook-type display device which may be quickly and easily restocked with product.

It is yet another object of the present invention to provide a hook-type display device which may be easily assembled and disassembled, and which is readily securable to existing gondola display structures.

SUMMARY OF THE INVENTION

The aforementioned objects, as well as others which will become apparent to those skilled in the art, are achieved by a merchandise display device, securable to an upright member, for supporting a plurality of articles each having a centrally positioned aperture. The device comprises an elongated member having a distal end dimensioned and arranged for insertion into a respective aperture of each article such that the articles are slidable along the elongated member into superposed relation.

The device further includes means for securing the elongated member to the upright member in an outwardly projecting manner and blocking means disposed proximate the distal end of the elongated member. The blocking means includes a portion insertable between first and second adjacent articles on the elongated member so as to permit removal of the first adjacent article and prevent removal of the second adjacent article.

In accordance with an illustrative embodiment of the present invention, the blocking means is a flap member which includes a cover portion and the insertable portion, the flap member being manipulable from a first position in which the cover portion depends downwardly and the insertable portion extends rearwardly therefrom in a plane above the adjacent articles into a second position in which the cover portion is inclined forwardly and the insertable portion is interposed between the adjacent articles. The flap member is pivotably supported by first and second elongated sections of a U-shaped member extending from the housing in a direction substantially parallel to the elongated member.

In accordance with one aspect of the present invention, the securing means includes a housing adapted to selectively retain the rod members in a first position parallel to the elongated member and a second, upwardly inclined position for elevating the flap member relative to the elongated member so that articles may be quickly positioned thereon during restocking.

The various features of novelty which characterize the invention are pointed out with particularity in the claims annexed to and forming a part of the disclosure.

BRIEF DESCRIPTION OF THE DRAWINGS

For a better understanding of the invention, its operating advantages, and specific object attained by its use, reference should be had to the descriptive matter in which there is described preferred embodiments of the invention and to the accompanying drawings, in which.

DETAILED DESCRIPTION OF THE PREFERRED EMBODIMENTS

Figures 1, 2:
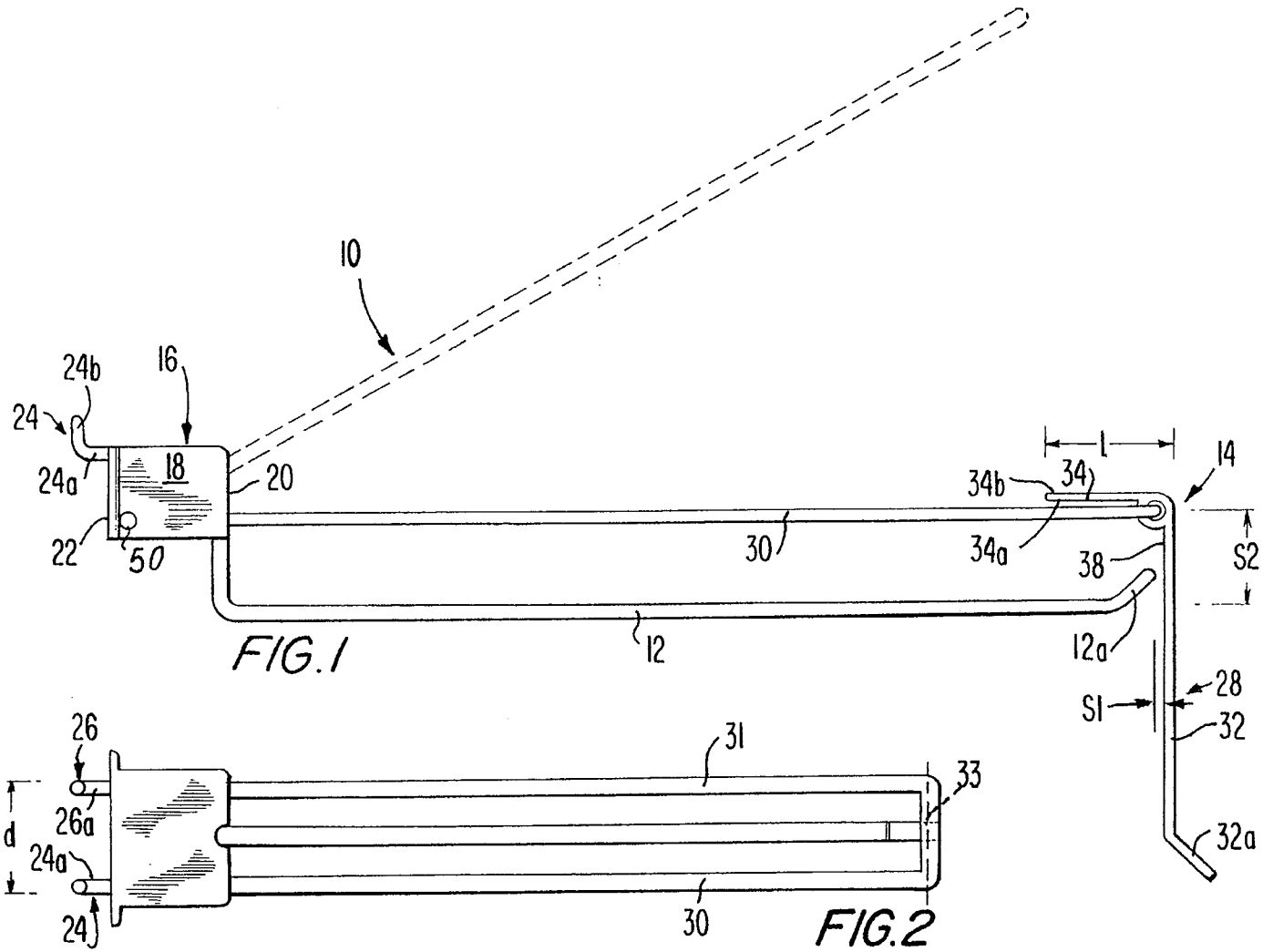
FIG. 1 is a side elevation view depicting a theft deterring, merchandise display device constructed in accordance with an illustrative embodiment of the present invention.
FIG. 2 is a plan view illustrating the article supporting and blocking member supporting assemblies employed by the present invention.

With initial reference to FIG. 1, there is shown an illustrative embodiment of a merchandise display device 10 constructed in accordance with the teachings of the present invention. As shown in FIG. 1, display device 10 includes an elongated member 12 for supporting a plurality of articles (not shown) in superposed relation. The construction of elongated member 12 is substantially similar to that of a conventional peg hook. Thus, the cross sectional profile (e.g., diameter) of elongated member 12 is selected so that it is smaller than that of the central aperture of each package to be supported thereby. To prevent items from slipping off elongated member 12, the distal tip portion 12*a* may be angled slightly upward relative to the horizontal.

With continuing reference to FIG. 1, it will be observed that display device 10 further includes a blocking assembly 14 and a securing assembly 16 for securing the elongated member 12 and blocking assembly 14 to the upright panel of a conventional gondola display structure (not shown) or similar structure. Because the construction of gondola display structures is well known by those skilled in the art, a detailed description and illustration of the same has been omitted for clarity. In the illustrative embodiment of FIG. 1, an upright panel having a "pegboard" configuration, that is, defining a pattern of vertically and horizontally spaced apertures, is contemplated. Thus, securing assembly 16 includes a housing 18 defining a front surface 20 and a rear surface 22, and first and second L-shaped members 24 and 26 (FIG. 2).

As shown in FIGS. 1 and 2, the base 24*a* and 26*a* of each respective L-shaped member is received within the housing 18 so as to project rearwardly therefrom while the proximal end of the elongated member 12 is received within the housing to project forwardly therefrom. Each of L-shaped members 24 and 26 further includes an upwardly extending portion, 24*b* and 26*b*, respectively. The horizontal spacing d between L-shaped members 24 and 26 is selected to correspond to the horizontal spacing between apertures of the gondola panel member. Thus, as will be readily ascertained by those skilled in the art, the upwardly extending portions 24*b* and 26*b* of each L-shaped member may be respectively inserted into a corresponding pair of panel apertures so that the rear surface 22 of housing 18 is supported by the surface of the gondola member and so that the elongated member 12 extends toward the consumer in a substantially horizontal orientation.

Because the design of the upright panels employed in a given display structure may, in fact, vary widely, it will be, readily ascertained by those skilled in the art that various modifications may be required to securing assembly 16 in order to achieve the desired connection of elongated member 12 thereto. By way of example, if in lieu of circular apertures, the upright panel member defines horizontally spaced, vertical slots, rearwardly extending tangs may be utilized to secure the housing thereto. Moreover, in the event no apertures or slots are defined in the upright panel or other vertical mounting surface, suitable mechanical fasteners may be utilized to provide a somewhat "permanent" mounting arrangement. In any event, it should be understood that the above described securing assembly 16, as well as the suggested modifications thereto, are discussed for illustrative purposes only and that any suitable means may be utilized to secure the elongated member 12 and blocking assembly 14 to an upright surface.

With continued reference to the illustrative embodiment depicted in FIGS. 1 and 2, it will be observed that blocking assembly 14 includes a pivotable flap member 28 which is pivotably supported by a pair of parallel elongated sections 30 and 31 of a U-shaped rod member 33.

Figure 3:
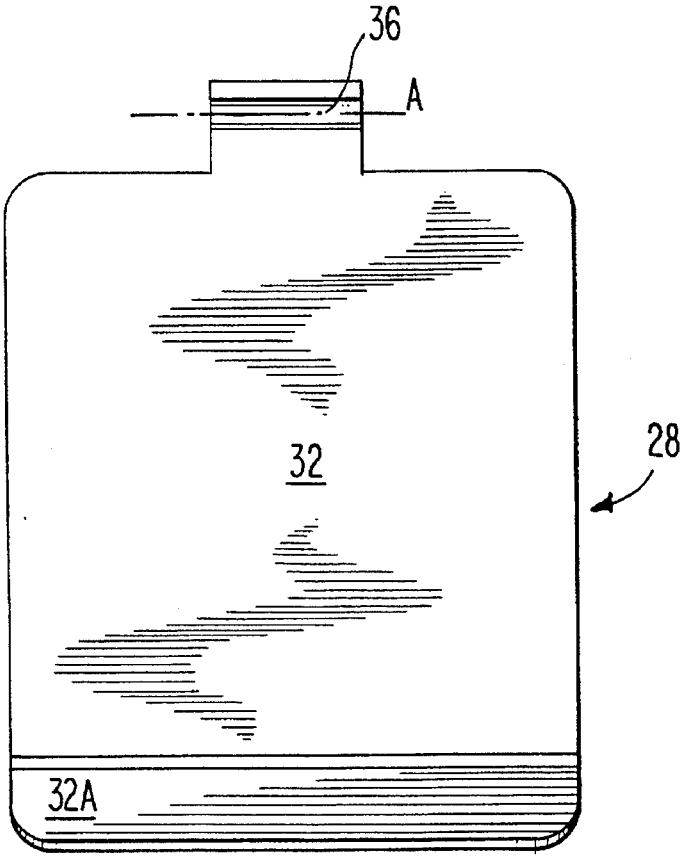
FIG. 3 is a front elevation view of the securing assembly utilized by the present invention.

With reference now to FIGS. 1 and 3, it will be observed that flap member 28 includes a substantially planar cover portion 32 and a blocking portion 34 which extends rearwardly therefrom. As best seen in FIG. 3, a lateral bore 36 dimensioned to receive the base of U-shaped rod 33 extends through the width of flap member 28 and, thus, defines the pivot axis A thereof. It should, of course, be understood that various structures may be employed for positioning flap member for pivotal movement proximate the distal end of elongated member 12. For example, in lieu of a single U-shaped member as 33, the flap member may be pivotably supported by a pair of parallel, elongated L-shaped sections in which the base of each L-shaped section is received within opposite ends of lateral bore 36. In any event, and as will now be explained, pivotable flap member 28 serves to regulate access to the articles supported by elongated member 12.

When in the "at-rest" position shown in FIG. 1, cover portion 32 extends downwardly in a substantially vertical plane so that its rear surface 38 is positioned proximate the distal tip of elongated member 12. The spacing s1 between the distal tip and rear surface 38 is selected so that pivoting of the flap member 28 from the at-rest position is required prior to removing an articles from elongated member 12. As will be immediately recognized by those skilled in the art, this distance will depend in large part upon the depth dimension of the articles being displayed. For purposes of illustration, however, a spacing of 0.32 inches has been determined to be satisfactory for the most common packaging configurations. In this regard, it should also be noted that the height and width of cover portion 32 need not be selected to completely cover the articles supported on elongated member 12. However, in order to enable the consumer to view the article packaging and thus preserve the desired aesthetic impact thereof, cover portion 32 is preferably fabricated from a transparent plastic material.

As indicated above, the cover portion 32 depends downwardly in front of the displayed articles when the flap member 28 is in the at-rest position. Because the elongated rod sections 30 and 31 which support flap member 28 are disposed above elongated member 12, blocking portion 34 extends above elongated member 12 in the at-rest position and is thus positioned above the articles supported thereby. Accordingly, although articles may not be removed from elongated member 12 prior to pivoting of flap member 28, the articles may be simultaneously slid forwardly as required during "facing" by store personnel.

Removal of an article from elongated member 12 by the consumer is performed by lifting cover portion 32 upward and sliding the article forward beyond the distal tip 12*a* of the elongated member. In the embodiment of FIG. 1, lifting of panel member 28 is facilitated by a forwardly inclined portion 32*a* at the lower region of cover portion 32. As the cover portion 32 is lifted, the blocking portion 34 moves downward until it reaches a blocking position in which it is disposed between adjacent articles on elongated member 12. Thus, once the cover position has been lifted, only those articles positioned between the forward surface 34*a* of the blocking portion and the distal tip of elongated member 12 may be removed at one time, with those articles disposed behind the rear surface 34*b* of blocking portion 34 being blocked from forward movement until the panel member 28 is returned to the at-rest position.

The number of articles which may be removed at any given time will, of course, depend upon the length l of blocking portion 34, the angle by which the blocking portion extends from cover portion 32, and the vertical spacing s2 between the elongated member 12 and support rod sections 30 and 31. It is contemplated that each of these parameters may be varied to accommodate the dimensions of the articles to be displayed upon display device 10. For purposes of illustration, a length l of 1 inch, an angle of 90°, and a spacing s2 of 1 inch may be utilized for packaged rolls of film or a typical one-dozen package of condoms.

In order to permit rapid restocking of display device 10, housing 18 is preferably configured to permit movement of the blocking assembly from its operative position, in which elongated parallel rod sections 30 and 31 are retained in a substantially horizontal position into an elevated, inoperative position, in which the elongated rod sections are retained in an upwardly inclined position (shown in dotted line form in FIG. 1 ). As indicated in FIG. 1, the ends of U-shaped rod member 33 are bent outwardly at a 90° angle and are pivotably received in a respective aperture 50 (only one of which is shown in FIG. 1) defined in corresponding lateral sidewalls of housing 18.

Figure 4:
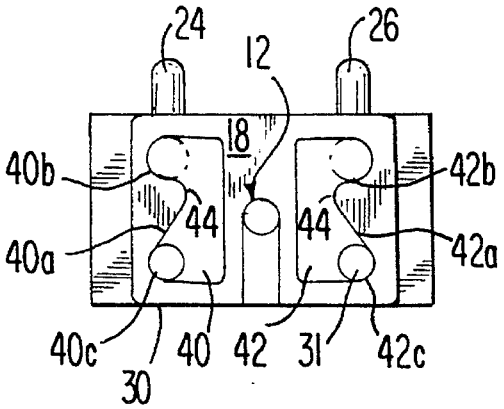
FIG. 4 is front elevation view of the blocking member depicted in FIG. 1.

With particular reference now to FIG. 4, it will be observed that housing 18 defines first and second openings 40 and 42 which define upwardly diverging sidewall surfaces 40*a* and 42*a*. The upper end of each diverging surface 40, 42 terminates at an upwardly directed abutment surface 40*b*, 42*b*, respectively while the lower end terminated at an upwardly directed abutment surface 40*c*, 42*c*, respectively. In FIG. 4, elongated rod sections 30 and 31 are shown as being supported by housing 18 in their substantially horizontal position, thereby indicating that blocking assembly 14 is in the operative position shown in FIG. 1.

In order to move U-shaped rod 33 into the dotted line position of FIG. 1 and thus permit restocking of display device 10 without interference from flap member 28, rod sections 30 and 31, are pushed together slightly and lifted so that they slide along diverging surfaces 40*a* and 40*b*, respectively. Eventually, the rod sections ride up over the arcuate corners 44 and are forced by spring tension into engagement with abutments 40*b* and 42*b* and into the dotted line positions of FIG. 4. While in this orientation, articles may be quickly added or replaced in a highly efficient manner. As will be recognized by those skilled in the art, the above-described procedure is easily reversed to restore the blocking assembly to its operative position.

The invention is not limited by the embodiments described above which are presented as examples only but can be modified in various ways within the scope of protection defined by the appended patent claims.

What is claimed is:

1. A merchandise display device, securable to an upright member, for supporting a plurality of articles, each of said articles defining a centrally positioned aperture, comprising:

an elongated member having a distal end dimensioned and arranged for insertion into a respective aperture of each article, the articles being slidable along said elongated member into superposed relation;

securing means for securing said elongated member to the upright member in an outwardly projecting manner; and blocking means disposed proximate said distal end, said blocking means including a portion insertable between first and second adjacent articles on said elongated member so as to permit removal of the first adjacent article and prevent removal of the second adjacent article.

2. The display device according to claim 1, further including supporting means securable to said upright member for supporting said blocking means.

3. The display device according to claim 2, wherein said supporting means is coupled to said securing means.

4. The display device according to claim 3, wherein said securing means includes a housing having front and rear surfaces, a proximal end of said elongated member being supported within said housing.

5. The display device according to claim 4, wherein the from surface of said housing defines a bore for retaining the proximal end of said elongated member.

6. The display device according to claim 4, wherein said supporting means includes at least one elongated section extending from said housing in a direction substantially parallel to said elongated member, and wherein said blocking means further includes a flap member pivotably supported by a distal end of said elongate section.

7. The device according to claim 6, wherein said flap member includes a cover portion and said insertable portion, said flap member being manipulable from a first position in which said cover portion depends downwardly and said insertable portion extends rearwardly therefrom in a plane above the adjacent articles into a second position in which said cover portion is inclined forwardly and said insertable portion is interposed between the adjacent articles.

8. The display device according to claim 6, further including means for selectively retaining said blocking means in an operative position, in which said at least one elongated section is substantially parallel to said elongated member and an elevated, inoperative position, in which said at least one elongate section is upwardly inclined relative to said elongated member, thereby permitting articles to be quickly positioned onto said elongated member.

9. The display device according to claim 6, wherein said at least one elongated section comprises first and second elongated sections defined by a U-shaped member, said U-shaped member further including a base for pivotably supporting said flap member.

10. The display device according to claim 1, further including means for selectively retaining said blocking means in an operative position relative to said elongated member and in an elevated, inoperative position relative to said elongated member, thereby permitting articles to be quickly positioned onto said elongated member.

11. The display device according to claim 2, wherein said supporting means includes at least one elongated section extending from said housing in a direction substantially parallel to said elongated member, and wherein said blocking means further includes a flap member pivotably supported by said elongated section.

12. The display device according to claim 9, wherein said at least one elongated section comprises first and second elongated sections defined by a U-shaped member, said U-shaped member further including a base for pivotably supporting said flap member.

13. The display device according to claim 11, wherein said flap member includes a cover portion and said insertable portion, said flap member being manipulable from a first position in which said cover portion depends downwardly and said insertable portion extends rearwardly therefrom in a plane above the adjacent articles into a second position in which said cover portion is inclined forwardly and said insertable portion is interposed between the adjacent articles.

14. The display device according to claim 11, further including means for selectively retaining said flap member in an operative position, in which said at least one elongated section is substantially parallel to said elongated member and an elevated, inoperative position, in which said at least one elongated section is upwardly inclined relative to said elongated member, thereby permitting articles to be quickly positioned onto said elongated member.

* * * * *